US009630239B2

(12) United States Patent
Okubo et al.

(10) Patent No.: US 9,630,239 B2
(45) Date of Patent: Apr. 25, 2017

(54) APPARATUS FOR FORMING A BLANK FOR FINISH FORGING FOR A FORGED CRANKSHAFT

(71) Applicant: NIPPON STEEL & SUMITOMO METAL CORPORATION, Tokyo (JP)

(72) Inventors: Junichi Okubo, Amagasaki (JP); Kenji Tamura, Takatsuki (JP); Kunihiro Yoshida, Nishinomiya (JP); Tomihiko Fukuyasu, Tokyo (JP); Nobutaka Tanimoto, Fostoria, OH (US); Tadashi Matsui, Gurgaon (IN)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 39 days.

(21) Appl. No.: 14/425,410

(22) PCT Filed: Sep. 3, 2013

(86) PCT No.: PCT/JP2013/005199

§ 371 (c)(1),
(2) Date: Mar. 3, 2015

(87) PCT Pub. No.: WO2014/038183

PCT Pub. Date: Mar. 13, 2014

(65) Prior Publication Data

US 2015/0231689 A1 Aug. 20, 2015

(30) Foreign Application Priority Data

Sep. 7, 2012 (JP) ..... 2012-197034

(51) Int. Cl.
*B21K 1/08* (2006.01)
*B21D 22/00* (2006.01)
(Continued)

(52) U.S. Cl.
CPC ..... *B21K 1/08* (2013.01); *B21J 1/04* (2013.01); *Y10T 29/17* (2015.01)

(58) Field of Classification Search
CPC ..... B21J 1/04; B21J 9/02; B21J 9/12; Y10T 29/17; B21K 1/08
(Continued)

(56) References Cited

U.S. PATENT DOCUMENTS 2,653,373 A * 9/1953 Brauchler ..... B21K 1/08 164/347
3,650,143 A * 3/1972 Ruget ..... B21K 1/08 29/6.01
(Continued)

FOREIGN PATENT DOCUMENTS

JP 2008-155275 7/2008
JP 2011-110592 6/2011
(Continued)

*Primary Examiner* — Sarang Afzali
*Assistant Examiner* — Darrell C Ford
(74) *Attorney, Agent, or Firm* — Clark & Brody

(57) ABSTRACT

In a forming apparatus, stationary journal dies (10U, 10B) and movable journal dies (11U, 11B) each hold and retain rough journal portions (J') of a preform blank (4) therebetween, and crank pin dies (12) contacts rough crank pin portions (P') thereof, and in this state, the movable journal dies (11U, 11B) are moved axially toward the stationary journal dies (10U, 10B) and the crank pin dies (12) are moved in the same axial direction and in an eccentric direction. Rough crank arm portions (A') are axially compressed to reduce their thickness to that of crank arms of a forged crankshaft, and the rough crank pin portions (P') are pressed in the eccentric direction to increase eccentricity to that of the crank pins of the forged crankshaft. Consequently, it is possible to form a blank for finish forging having a shape generally in agreement with the shape of the forged crankshaft.

17 Claims, 7 Drawing Sheets

(51) Int. Cl.
*B21J 5/00* (2006.01)
*B21J 13/00* (2006.01)
*B21J 1/04* (2006.01)

(58) Field of Classification Search
USPC ..... 72/353.2, 353.6, 354.2, 354.8, 357; 29/6.01
See application file for complete search history.

(56) References Cited

U.S. PATENT DOCUMENTS 4,041,755 A * 8/1977 Rut ..... B21J 13/025 29/6.01
4,578,975 A * 4/1986 Matsumoto ..... B21K 1/08 29/6.01
2009/0126449 A1* 5/2009 Sakae ..... B21C 23/142 72/356
2010/0326235 A1* 12/2010 Kilbon ..... B21J 5/02 74/595
2011/0308052 A1* 12/2011 Ohnuma ..... B21J 5/02 29/6.01
2012/0024105 A1* 2/2012 Ohnuma ..... B21J 5/02 74/605
2015/0231710 A1* 8/2015 Nagata ..... B23B 49/04 408/1 R
2015/0321245 A1* 11/2015 Tahira ..... B21K 1/08 74/595

FOREIGN PATENT DOCUMENTS

JP 2011-161496 8/2011
JP 2012-161819 8/2012
WO 2012/035663 3/2012

* cited by examiner

PRIOR ART

APPARATUS FOR FORMING A BLANK FOR FINISH FORGING FOR A FORGED CRANKSHAFT

TECHNICAL FIELD

The present invention relates to techniques for manufacturing, by hot forging, a crankshaft (hereinafter also referred to as a "forged crankshaft") for a multiple cylinder engine having two or more cylinders. In particular, the present invention relates to an apparatus for forming, in the process of manufacturing a forged crankshaft, a blank for finish forging to be subjected to finish forging by which the final shape of the forged crankshaft is obtained.

BACKGROUND ART

A crankshaft is a principal component of a reciprocating engine, which produces power by converting reciprocating motion of pistons to rotary motion. Generally, there are two types of crankshafts: those that are manufactured by forging and those that are manufactured by casting. For engines of automobiles such as passenger cars, freight cars, and specialized work vehicles, particularly multiple cylinder engines having two or more cylinders, it is necessary that their crankshafts have high strength and stiffness, and therefore forged crankshafts, which are more capable of meeting the need, are widely used. For multiple cylinder engines of motorcycles, agricultural machines, marine vessels, and the like, forged crankshafts are also used.

In general, forged crankshafts for multiple cylinder engines are manufactured by using, as a starting material, a billet having a circular or square cross section and having a constant cross-sectional area along the entire length, and subjecting the billet to the steps of preforming, die forging, trimming and coining in order. The preforming step includes roll forming and bending, and the die forging step includes block forging and finish forging.

FIG. 1 is a schematic diagram illustrating a typical conventional process for manufacturing a forged crankshaft. A crankshaft 1 illustrated in FIG. 1 is intended to be mounted in a 4-cylinder engine. It is a 4-cylinder 8-counterweight crankshaft that includes: five journals J1 to J5; four crank pins P1 to P4; a front part Fr, a flange F1, and eight crank arms (hereinafter referred to as "crank arms") A1 to A8 that connect the journals J1 to J5 and the crank pins P1 to P4 to each other, wherein each of the eight crank arms A1 to A8 has a balance weight. Hereinafter, when the journals J1 to J5, the crank pins P1 to P4, and the crank arms Al to A8 are each collectively referred to, a reference character "J" is used for the journals, a reference character "P" for the crank pins, and a reference character "A" for the crank arms.

According to the manufacturing method shown in FIG. 1, the forged crankshaft 1 is manufactured in the following manner. Firstly, a billet 2 shown in FIG. 1(*a*), which has been previously cut to a predetermined length, is heated by an induction heater or a gas atmosphere furnace and then is subjected to roll forming In the roll forming step, the billet 2 is rolled and reduced in cross section by grooved rolls, for example, to distribute its volume in the longitudinal direction, whereby a rolled blank 103, which is an intermediate material, is formed (see FIG. 1(*b*)). In the bending step, the rolled blank 103 obtained by roll forming is partially pressed in a press in a direction perpendicular to the longitudinal direction to distribute its volume, whereby a bent blank 104, which is a secondary intermediate material, is formed (see FIG. 1(*c*)).

Then, in the block forging step, the bent blank 104 obtained by bending is press forged with a pair of upper and lower dies, whereby a forged blank 105 having a general shape of a crankshaft (forged final product) is formed (see FIG. 1(*d*)). Then, in the finish forging step, the block forged blank 105 obtained by block forging is further processed by press forging the block forged blank 105 with a pair of upper and lower dies, whereby a forged blank 106 having a shape in agreement with the shape of the crankshaft is formed (see FIG. 1(*e*)). In the block forging and the finish forging, excess material flows out as a flash from between the parting surfaces of the dies that oppose each other. Thus, the block forged blank 105 and the finish forged blank 106 have large flashes 105*a*, 106*a*, respectively, around the formed shape of the crankshaft.

In the trimming step, the finish forged blank 106 with the flash 106*a*, obtained by finish forging, is held by dies from above and below and the flash 106*a* is trimmed by a cutting die. In this manner, the forged crankshaft 1 is obtained as shown in FIG. 1(*f*). In the coining step, principal parts of the forged crankshaft 1, from which the flash has been removed, e.g., shaft parts such as the journals J, the crank pins P, the front part Fr, and the flange F1, and in some cases the crank arms A, are slightly pressed with dies from above and below and formed into a desired size and shape. In this manner, the forged crankshaft 1 is manufactured.

The manufacturing process shown in FIG. 1 is applicable not only to a 4-cylinder 8-counterweight crankshaft as exemplified, but also to a 4-cylinder 4-counterweight crankshaft in which, among 8 crank arms A, the leading first crank arm A1, the trailing eighth crank arm A8, and the two central, fourth and fifth crank arms A4, A5 have balance weights. Also, the same manufacturing process can be applied to crankshafts that are to be mounted in a 3-cylinder engine, an inline 6-cylinder engine, a V-type 6-cylinder engine, an 8-cylinder engine, and the like. It is noted that, when adjustment of the placement angle of the crank pins is necessary, a step of twisting is added after the trimming step.

With such a manufacturing method, it is inevitable that material utilization decreases because large amounts of unnecessary flash, which is not a part of the end product, are generated. Thus, in the manufacturing of a forged crankshaft, it has so far been an important object to inhibit the generation of flash to the extent possible and achieve improvement of material utilization. Examples of conventional techniques that address this object are as follows.

For example, Patent Literature 1 discloses a technique for manufacturing a crankshaft, the technique including: using, as a blank, a stepped round bar having reduced diameter regions at portions to be formed into journals and crank pins of a crankshaft; holding, with dies, a pair of the portions to be formed into journals, between which a portion to be formed into a crank pin is disposed and, in this state, axially moving the opposing dies toward each other to compressively deform the round bar blank; pressing punches against the portion to be formed into a crank pin in a direction perpendicular to the axial direction to place the portion to be formed into a crank pin into an eccentric position; and repeating the above operations in succession for all crank throws, whereby the journals and the crank pins are shaped and the crank arms are roughly shaped.

Patent Literature 2 discloses a technique for manufacturing a crankshaft, the technique including: using, as a blank, a simple round bar; holding one end of the two ends of the round bar with a stationary die and the other end thereof with a movable die, and holding a portion to be formed into a journal with journal dies and portions to be formed into crank pins with crank pin dies; in this state, axially moving the movable die, the journal dies and the crank pin dies toward the stationary die to compressively deform the round bar blank; and moving the crank pin dies in an eccentric direction perpendicular to the axial direction to place the portion to be formed into the crank pin into an eccentric position, whereby the journals and the crank pins are shaped and the crank arms are roughly shaped.

With both the techniques disclosed in Patent Literatures 1 and 2, no flash will be generated, and therefore a significant improvement in material utilization can be expected.

CITATION LIST

Patent Literature

Patent Literature 1: Japanese Patent Application Publication No. 2008-155275

Patent Literature 2: Japanese Patent Application Publication No. 2011-161496

SUMMARY OF INVENTION

Technical Problem

As described above, according to the techniques disclosed in Patent Literatures 1 and 2, a round bar blank is directly processed into a crankshaft shape. However, blanks for a forged crankshaft are not easily deformable because forged crankshafts are required to have high strength and high stiffness. Thus, crankshafts that would be practically manufacturable are inevitably limited to such ones having crank arms of large thickness and crank pins with a small amount of eccentricity, and therefore having a relatively gentle crankshaft shape. Moreover, the shape of the crank arms is limited to a simple one without a balance weight.

In addition, according to the techniques disclosed in Patent Literatures 1 and 2, the shape of crank arms is formed by free expansion of a round bar blank in a direction perpendicular to the axial direction in conjunction with its axial compressive deformation and by tensile deformation of the round bar blank in conjunction with the movement of portions to be formed into crank pins in an eccentric direction. Because of this, the contour shape of the crank arms tend to be unstable, and thus dimensional accuracy cannot be ensured.

The present invention has been made in view of the foregoing problems. Accordingly, in order to manufacture forged crankshafts for multiple cylinder engines with high material utilization and also with high dimensional accuracy regardless of their shapes, it is an object of the present invention to provide an apparatus for use in forming a blank for finish forging to be subjected to finish forging on the premise that, in the process of manufacturing a forged crankshaft, finish forging for forming its final shape is performed.

Solution to Problem

In order to achieve the above object, the present invention is directed to an apparatus for forming a blank for finish forging for a forged crankshaft as set forth below.

A forming apparatus of the present invention is an apparatus for forming, in the process of manufacturing a forged crankshaft for a multiple cylinder engine, a blank for finish forging to be subjected to finish forging by which a final shape of the forged crankshaft is formed, the apparatus configured to form the blank for finish forging from a preform blank having a crankshaft shape, the preform blank including: rough journal portions having an axial length equal to an axial length of journals of the forged crankshaft; rough crank pin portions having an axial length equal to an axial length of crank pins of the forged crankshaft and having a smaller amount of eccentricity in an eccentric direction perpendicular to the axial direction than an amount of eccentricity of the crank pins of the forged crankshaft; and rough crank arm portions having an axial thickness greater than an axial thickness of crank arms of the forged crankshaft, the apparatus having a configuration described below.

Specifically, the forming apparatus of the present invention includes: stationary journal dies disposed at locations corresponding to a location of one rough journal portion of the rough journal portions, the stationary journal dies configured to hold and retain the rough journal portion therebetween in the eccentric direction perpendicular to the axial direction, the stationary journal dies configured to be in contact with side surfaces of corresponding ones of the rough crank arm portions, the corresponding ones of the rough crank arm portions connecting with the rough journal portion; movable journal dies disposed at locations corresponding to locations of the rough journal portions excluding the rough journal portion to be held by the stationary journal dies, the movable journal dies configured to hold and retain the rough journal portions therebetween in the eccentric direction perpendicular to the axial direction, the movable journal dies configured to move axially toward the stationary journal dies while being in contact with side surfaces of corresponding ones of the rough crank arm portions, the corresponding ones of the rough crank arm portions each connecting with a corresponding one of the rough journal portions; and crank pin dies disposed at locations corresponding to locations of the rough crank pin portions, the crank pin dies configured to be brought into contact with the respective rough crank pin portions at inner sides thereof, the crank pin dies configured to move axially toward the stationary journal dies and in the eccentric direction perpendicular to the axial direction while being in contact with side surfaces of corresponding ones of the rough crank arm portions, the corresponding ones of the rough crank arm portions each connecting with a corresponding one of the rough crank pin portions, wherein, in a state where the rough journal portions are held and retained by the stationary journal dies and the movable journal dies and the rough crank pin portions are contacted by the crank pin dies, the movable journal dies are moved axially, and the crank pin dies are moved axially and in the eccentric direction, thereby compressing the rough crank arm portions in the axial direction so as to reduce the thickness thereof to the thickness of the crank arms of the forged crankshaft, and pressing the rough crank pin portions in the eccentric direction so as to increase the amount of eccentricity thereof to the amount of eccentricity of the crank pins of the forged crankshaft.

In the above forming apparatus, it is preferred that the crank pin dies each include an auxiliary crank pin die disposed at a location facing an outer side, opposite to the inner side, of each rough crank pin portion, the auxiliary crank pin dies configured to move axially, and preferred that the movement of the crank pin dies in the eccentric direction is controlled so that the rough crank pin portions to be eccentrically deformed reach the auxiliary crank pin dies after spaces between the stationary journal dies and the movable journal dies and corresponding ones of the crank pin dies and the auxiliary crank pin dies are filled by the axial movement of the movable journal dies as well as the axial movement of the crank pin dies and the auxiliary crank pin dies.

This forming apparatus preferably has a configuration such that, provided that a total length of movement of the crank pin dies in the eccentric direction is a 100% length of movement thereof, when the axial movement of the movable journal dies that are adjacent to the crank pin dies is completed, a length of movement of the crank pin dies in the eccentric direction is 90% or less of the total length of movement, and thereafter, the movement of the crank pin dies in the eccentric direction is completed.

Furthermore, the above forming apparatus may have a configuration such that the stationary journal dies, the movable journal dies, and the crank pin dies are mounted on a press machine that is capable of being moved downward along the eccentric direction and, by the downward movement of the press machine, the stationary journal dies and the movable journal dies are caused to hold and retain the rough journal portions therebetween while the crank pin dies are brought into contact with the rough crank pin portions; and with continued downward movement of the press machine, the movable journal dies are moved axially by wedge mechanisms, and the crank pin dies are caused to move axially by the movement of the movable journal dies.

In the case of this forming apparatus, it is preferred that the wedge mechanisms have different wedge angles for each movable journal die. Furthermore, it is preferred that the crank pin dies are coupled to a hydraulic cylinder and caused to move in the eccentric direction by driving the hydraulic cylinder.

Furthermore, the above forming apparatus has a configuration such that, when the rough journal portions have a cross-sectional area greater than the cross-sectional area of the journals of the forged crankshaft and the rough crank pin portions have a cross-sectional area greater than the cross-sectional area of the crank pins of the forged crankshaft, the cross-sectional area of the rough journal portions can be reduced to the cross-sectional area of the journals of the forged crankshaft by holding and retaining of the rough journal portions by the stationary journal dies and the movable journal dies and subsequent axial movement of the movable journal dies; and the cross-sectional area of the rough crank pin portions can be reduced to the cross-sectional area of the crank pins of the forged crankshaft by the axial movement as well as the movement in the eccentric direction of the crank pin dies.

Advantageous Effects of Invention

With the forming apparatus of the present invention, it is possible to form, from a preform blank without a flash, a blank for finish forging without a flash which has a shape generally in agreement with the shape of a forged crankshaft having thin crank arms. When such a blank for finish forging is subjected to finish forging, it is possible to obtain the final shape of a forged crankshaft including the contour shape of crank arms although some minor amount of flash is generated. Thus, forged crankshafts for multiple cylinder engines can be manufactured with high material utilization and also with high dimensional accuracy regardless of their shapes.

DESCRIPTION OF EMBODIMENTS

The present invention is based on the premise that, in manufacturing a forged crankshaft for multiple cylinder engines, finish forging is performed in the manufacturing process. The forming apparatus of the present invention is used for forming, in a step prior to finish forging, a blank for finish forging to be subjected to the finish forging, from a preform blank. With regard to the apparatus for forming a blank for finish forging for a forged crankshaft according to the present invention, embodiments thereof are described in detail below.

1. Preform Blank To Be Processed and Blank For Finish Forging Formed Therefrom

Figure 2:
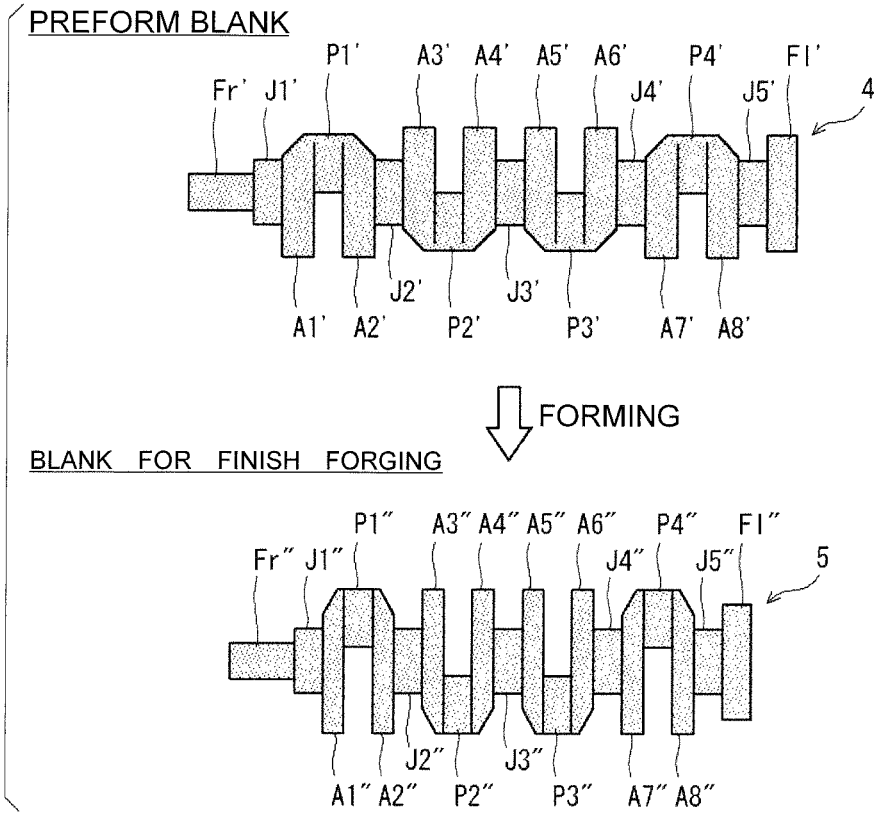
FIG. 2 is a plan view schematically showing the shapes of a preform blank to be processed by the forming apparatus of the present invention and a blank for finish forging formed therefrom.

FIG. 2 is a plan view schematically showing the shapes of a preform blank to be processed by the forming apparatus of the present invention and a blank for finish forging formed therefrom. FIG. 2 illustrates a preform blank and a blank for finish forging in the case of manufacturing a 4-cylinder 8-counterweight crankshaft.

Figure 1:
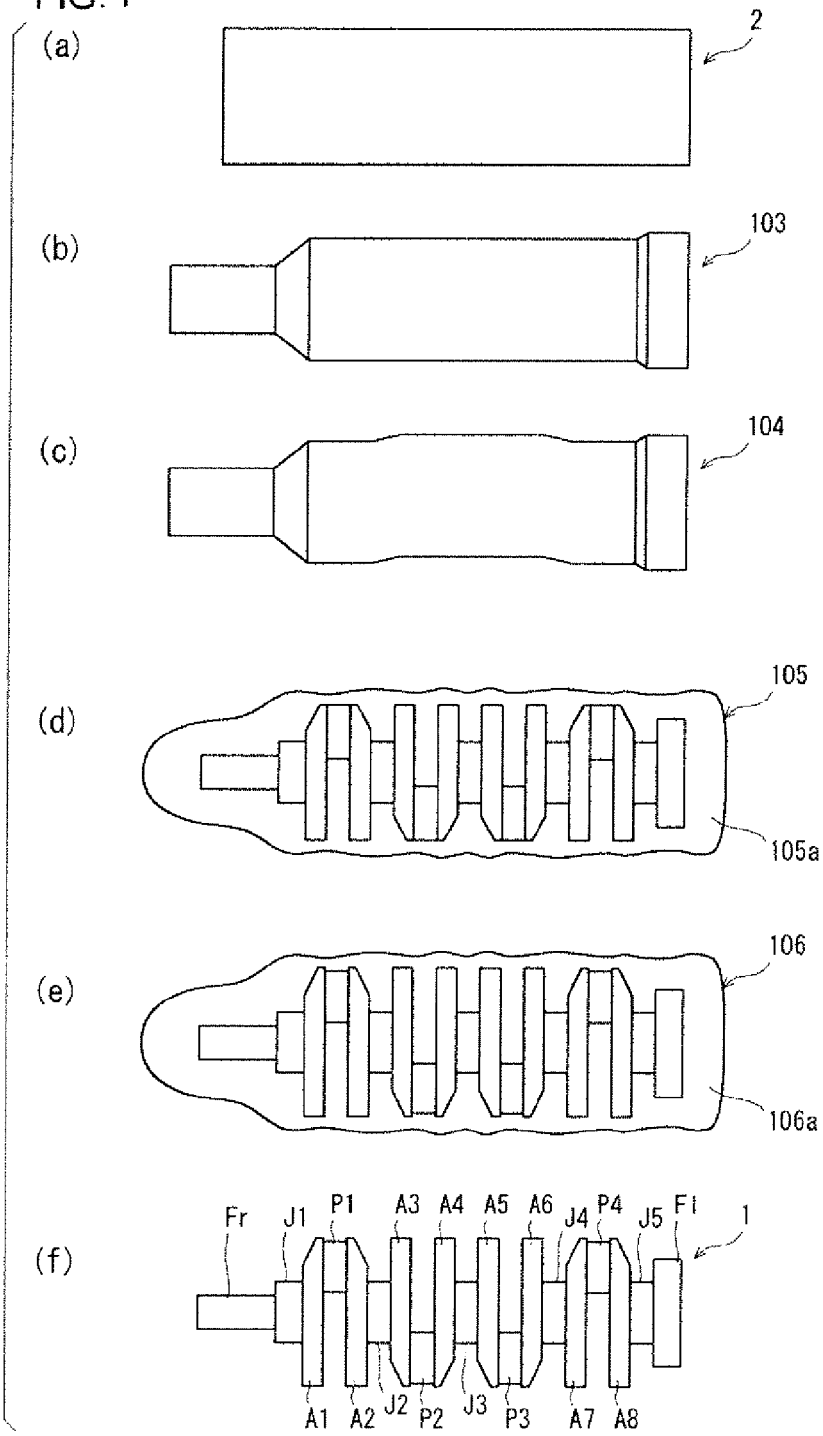
FIG. 1 is a schematic diagram illustrating a typical conventional process for manufacturing a forged crankshaft.

As shown in FIG. 2, the preform blank 4 has a crankshaft shape that is approximate to the shape of a forged crankshaft 1 shown in FIG. 1(*f*) but is generally rough. It includes: five rough journal portions J1' to J5'; four rough crank pin portions P1' to P4'; a rough front part portion Fr'; a rough flange portion F1'; and eight rough crank arm portions A1' to A8' (hereinafter also referred to simply as "rough arm portions A1' to A8'") that connect the rough journal portions J1' to J5' and the rough crank pin portions P1' to P4' to each other. The preform blank 4 has no flash. Hereinafter, when the rough journal portions J1' to J5', the rough crank pin portions P1' to P4', and the rough crank arm portions A1' to A8', of the preform blank 4, are each collectively referred to, a reference character "J'" is used for the rough journal portions, a reference character "P'" for the rough crank pin portions, and a reference character "A'" for the rough crank arm portions.

The blank for finish forging 5 is formed from the preform blank 4 described above using a forming apparatus, details of which will be provided later. It includes: five rough journal portions J1" to J5"; four rough crank pin portions P1" to P4"; a rough front part portion Fr"; a rough flange portion F1"; and eight rough crank arm portions A1" to A8" (hereinafter also referred to simply as "rough arm portions A1" to A8"") that connect the rough journal portions J1" to J5" and the rough crank pin portions P1" to P4" to each other. The blank for finish forging 5 has no flash. Hereinafter, when the rough journal portions J1" to J5", the rough crank pin portions P1" to P4", and the rough crank arm portions A" to A8", of the blank for finish forging 5, are each collectively referred to, a reference character "J"" is used for the rough journal portions, a reference character "P"" for the rough crank pin portions, and a reference character "A"" for the rough crank arm portions.

The blank for finish forging 5 has a shape that is generally in agreement with the shape of the crankshaft (forged final product), and it corresponds to the block forged blank 105 shown in FIG. 1(*d*) with a difference therebetween being the flash. Specifically, the rough journal portions J" of the blank for finish forging 5 have an axial length equal to that of the journals J of the forged crankshaft having the final shape. The rough crank pin portions P" of the blank for finish forging 5 have an axial length equal to that of the crank pins P of the forged crankshaft having the final shape, and have an amount of eccentricity in an eccentric direction perpendicular to the axial direction also equal to that of the crank pins P of the forged crankshaft. The rough crank arm portions A" of the blank for finish forging 5 have an axial thickness equal to that of the crank arms A of the forged crankshaft having the final shape.

Meanwhile, the rough journal portions J' of the preform blank 4 have an axial length equal to that of the rough journal portions J" of the blank for finish forging 5, i.e., that of the journals J of the forged crankshaft. The rough crank pin portions P' of the preform blank 4 have an axial length equal to that of the rough crank pin portions P" of the blank for finish forging 5, i.e., that of the crank pins P of the forged crankshaft, but have a smaller amount of eccentricity than that of the rough crank pin portions P" of the blank for finish forging 5. The rough crank arm portions A' of the preform blank 4 have an axial thickness greater than that of the rough crank arm portions A" of the blank for finish forging 5, i.e., that of the crank arms A of the forged crankshaft. In brief, compared to the blank for finish forging 5 (the forged crankshaft having the final shape), the preform blank 4 has an overall length that is relatively long by the additional thickness of the rough crank arm portions A', and has a relatively small amount of eccentricity of the rough crank pin portions P'. Thus, the preform blank 4 has a relatively gentle crankshaft shape.

Strictly speaking, though, the blank for finish forging 5 has such a configuration that, with respect to the final shape of the forged crankshaft, the rough arm portions A" is made slightly thinner and therefore the axial lengths of the rough journal portions J" and the rough crank pin portions P" are accordingly slightly greater. This is intended to ensure that the blank for finish forging 5 can be easily received by the dies when finish forging is performed and thereby prevent the occurrence of scoring. Correspondingly, the preform blank 4, too, has such a configuration that, with respect to the final shape of the forged crankshaft, the rough crank arm portions A' is made slightly thinner and therefore the axial lengths of the rough journal portions J' and the rough crank pin portions P' are accordingly slightly greater.

Such a preform blank 4 can be obtained by using a round billet having a circular cross section as a starting material and applying a preforming operation to the round billet. For example, the preform blank 4 can be obtained in such a manner that: the round billet is subjected to roll forming in which it is reduction-rolled by grooved rolls to distribute its volume in the longitudinal direction, and the resulting rolled blank is repeatedly subjected to bending (so-called "preforming") in which it is partially pressed in a press from a direction perpendicular to the longitudinal direction to distribute its volume. Also, the preform blank 4 may be obtained by using the techniques disclosed in Patent Literatures 1 and 2. Furthermore, cross roll forging or fully-enclosed die forging may also be employed.

2. Apparatus for Forming a Blank for Finish Forging

Figure 3:
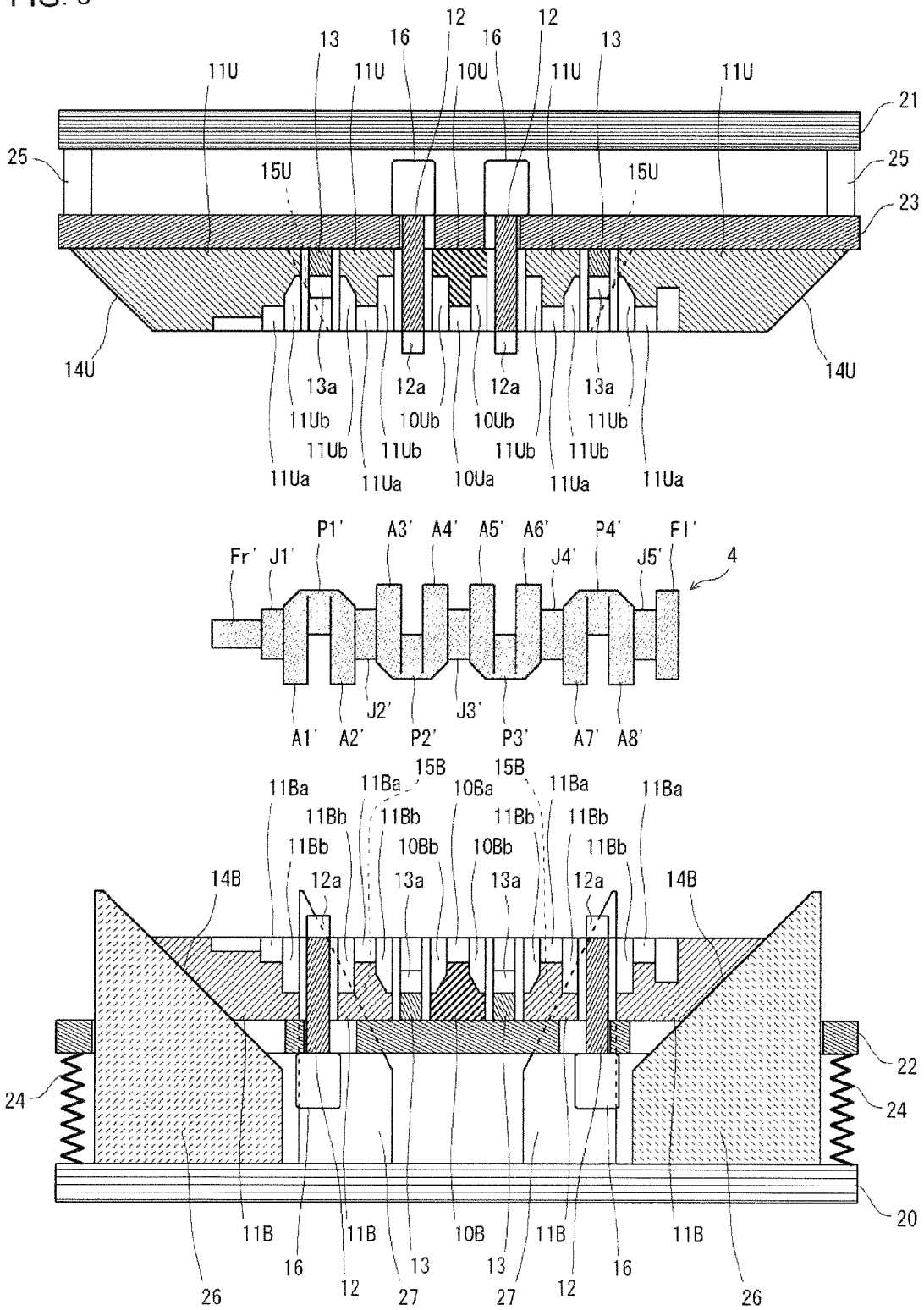
FIG. 3 is a longitudinal sectional view showing a configuration of the forming apparatus of the present invention.

FIG. 3 is a longitudinal sectional view showing a configuration of the forming apparatus of the present invention. FIG. 3 illustrates a forming apparatus that is used in manufacturing a 4-cylinder 8-counterweight crankshaft, i.e., a forming apparatus configured to form the blank for finish forging 5 from the preform blank 4 shown in FIG. 2.

As shown in FIG. 3, the forming apparatus is provided as a part of a press machine. It includes a stationary lower pressure pad 20 which serves as a base and an upper pressure pad 21 which is lowered by driving a ram of the press machine. A lower die holder 22, located over the lower pressure pad 20, is resiliently supported via resilient members 24. This lower die holder 22 is vertically movable. As the resilient members 24, disc springs, coil springs, air springs, or the like may be employed, or a hydraulic spring system may be employed. An upper die holder 23 is secured under the upper pressure pad 21 via support posts 25. This upper die holder 23 is lowered together with the upper pressure pad 21 by driving the press machine (ram).

In the forming apparatus shown in FIG. 3, the preform blank 4 is placed in the dies in such a manner that the eccentric direction of the rough crank pin portions P' is in the vertical direction, with the first and fourth rough crank pin portions P1', P4' positioned in the upper side, i.e., with the second and third rough crank pin portions P2', P3' positioned in the lower side, so that the preform blank is formed into the blank for finish forging. Thus, on the lower die holder 22 and the upper die holder 23, there are mounted stationary journal dies 10U, 10B, movable journal dies 11U, 11B, and crank pin dies 12 and auxiliary crank pin dies 13, with the upper ones and the lower ones being apart from each other with respect to the axial direction of the preform blank 4, each of them forming a pair with its upper or lower mate.

The stationary journal dies 10U, 10B, are disposed at locations corresponding to the location of one rough journal portion J', among the rough journal portions J', of the preform blank 4, e.g., the location of the central, third rough journal portion J3' in FIG. 3, with the upper stationary journal die mounted on the upper die holder 23 and the lower stationary journal die mounted on the lower die holder 22. Particularly, the stationary journal dies 10U, 10B, i.e., both the upper and lower ones, are completely secured to the upper die holder 23 and the lower die holder 22, respectively.

The stationary journal dies 10U, 10B have first impressions 10Ua, 10Ba, respectively, each having a semi-cylindrical shape and second impressions 10Ub, 10Bb, respectively, each located in front of or behind (left or right as seen in FIG. 3) the first impressions 10Ua, 10Ba and adjacent thereto. The length of the first impressions 10Ua, 10Ba is equal to the axial length of the third rough journal portion J3" of the blank for finish forging 5. The length of the second impressions 10Ub, 10Bb is equal to the axial thickness of the rough arm portions A" (the fourth and fifth rough arm portions A4", A5") of the blank for finish forging 5 which connect with the rough journal portions J3" thereof.

By the lowering of the upper die holder 23 caused by driving the press machine, i.e., the downward movement of the press machine, the stationary journal dies 10U, 10B are caused to hold and retain the third rough journal portion J3' therebetween from above and below with the first impressions 10Ua, 10Ba. Concurrently, the stationary journal dies 10U, 10B are placed in a state in which the second impressions 10Ub, 10Bb, at their first impression 10Ua, 10Ba-side surfaces, are in contact with the fourth and fifth rough arm portions A4', A5', at their third rough journal portion J3'-side side surfaces, the fourth and fifth rough arm portions A4', A5' connecting with the third rough journal portion J3'.

The movable journal dies 11U, 11B are disposed at locations corresponding to the locations of the rough journal portions J' of the preform blank 4 excluding the rough journal portion J' thereof to be held by the stationary journal dies 10U, 10B. For example, in FIG. 3, they are disposed at locations corresponding to the locations of the first, second, fourth and fifth rough journal portions J1', J2', J4', J5', with the upper ones mounted on the upper die holder 23 and the lower ones mounted on the lower die holder 22. Particularly, the movable journal dies 11U, 11B, i.e., both the upper and lower ones, are axially movable toward the stationary journal dies 10U, 10B on the upper die holder 23 and the lower die holder 22.

The movable journal dies 11U, 11B have first impressions 11Ua, 11Ba, respectively, each having a semi-cylindrical shape and second impressions 11Ub, 11Bb, respectively, each located in front of or behind (left or right as seen in FIG. 3) the first impressions 11Ua, 11Ba and adjacent thereto. The length of the first impressions 11Ua, 11Ba is equal to the axial length of the first, second, fourth, and fifth rough journal portions J1", J2", J4", J5" of the blank for finish forging 5. The length of the second impressions 11Ub, 11Bb is equal to the axial thickness of the rough arm portions A" of the blank for finish forging 5 each of which connects with a corresponding one of the rough journal portions J1", J2", J4", J5" thereof.

By the lowering of the upper die holder 23 caused by driving the press machine, i.e., the downward movement of the press machine, the movable journal dies 11U, 11B are caused to hold and retain their corresponding rough journal portions J' therebetween from above and below with the first impressions 11Ua, 11Ba. Concurrently, the movable journal dies 11U, 11B are placed in a state in which the second impressions 11Ub, 11Bb, at their first impression 11Ua, 11Ba-side surfaces, are in contact with their corresponding rough arm portions A', at their rough journal portion J'-side side surfaces, the corresponding rough arm portions A' each connecting with a corresponding one of the rough journal portions J'.

Here, it is noted that the movable journal dies 11U, 11B disposed at locations corresponding to the locations of the first and fifth rough journal portions J1', J5', at opposite ends, each have an end surface that is an inclined surface 14U, 14B. In relation to this, on the lower pressure pad 20, there are provided first wedges 26 located correspondingly to the locations of the inclined surfaces 14U, 14B of the movable journal dies 11U, 11B for the first and fifth rough journal portions J1', J5'. Each of the first wedges 26 extends upward penetrating through the lower die holder 22. The inclined surfaces 14B of the lower movable journal dies 11B, among the movable journal dies 11U, 11B for the first and fifth rough journal portions J1', J5', are in contact with the slopes of the first wedges 26 in the initial condition. On the other hand, the inclined surfaces 14U of the upper movable journal dies 11U are brought into contact with the slopes of the first wedges 26 by the lowering of the upper die holder 23 caused by driving the press machine, i.e., the downward movement of the press machine.

The movable journal dies 11U, 11B disposed at locations corresponding to the locations of the second and fourth rough journal portions J2', J4', which are closer to the center, are provided with blocks, not shown, secured at side sections (front and rear in FIG. 3) apart from the first impressions 11Ua, 11Ba and the second impressions 11Ub, 11Bb, the blocks having inclined surfaces 15U, 15B. In relation to this, on the lower pressure pad 20, there are provided second wedges 27 located correspondingly to the locations of the inclined surfaces 15U, 15B of the movable journal dies 11U, 11B for the second and fourth rough journal portions J2', J4'. Each of the second wedges 27 extends upward penetrating through the lower die holder 22. The inclined surfaces 15B of the lower movable journal dies 11B, among the movable journal dies 11U, 11B for the second and fourth rough journal portions J2', J4', are in contact with the slopes of the second wedges 27 in the initial condition. On the other hand, the inclined surfaces 15U of the upper movable journal dies 11U are brought into contact with the slopes of the second wedges 27 by the lowering of the upper die holder 23 caused by driving the press machine, i.e., the downward movement of the press machine.

Then, with continued downward movement of the press machine, the upper movable journal dies 11U are pressed downwardly together with the lower movable journal dies 11B. This allows the movable journal dies 11U, 11B for the first and fifth rough journal portions J1', J5', i.e., both the upper and lower ones, to move axially toward the stationary journal dies 10U, 10B for the third rough journal portion J3' as their inclined surfaces 14U, 14B slide along the slopes of the first wedges 26. Concurrently, the movable journal dies 11U, 11B for the second and fourth rough journal portions J2', J4', i.e., both the upper and lower ones, are allowed to move axially toward the stationary journal dies 10U, 10B for the third rough journal portion J3' as their inclined surfaces 15U, 15B slide along the slopes of the second wedges 27. In short, the movable journal dies 11U, 11B are all capable of being moved axially by the wedge mechanisms.

The crank pin dies 12 and the auxiliary crank pin dies 13, which form upper and lower pairs, are disposed at locations corresponding to the locations of the rough crank pin portions P' of the preform blank 4, with the upper ones mounted on the upper die holder 23 and the lower ones mounted on the lower die holder 22. The crank pin dies 12 are disposed at locations facing inner sides of the respective rough crank pin portions P', whereas the mating auxiliary crank pin dies 13 are disposed at locations facing outer sides, opposite to the inner sides, of the respective rough crank pin portions P'. For example, the first rough crank pin portion P1' is positioned at an upper side location, and thus the crank pin die 12 therefor is mounted on the lower die holder 22 and the auxiliary crank pin die 13 therefor is mounted on the upper die holder 23.

Particularly, all the crank pin dies 12 and the auxiliary crank pin dies 13, i.e., both the upper and lower ones, are axially movable toward the stationary journal dies 10U, 10B on the upper die holder 23 and the lower die holder 22. Furthermore, the crank pin dies 12 are movable in the eccentric direction toward the rough crank pin portions P'.

The crank pin dies 12 and the auxiliary crank pin dies 13 have impressions 12*a*, 13*a* having a semi-cylindrical shape, respectively. The length of the impressions 12*a*, 13*a* is equal to the axial length of the rough crank pin portions P" of the blank for finish forging 5.

By the lowering of the upper die holder 23 caused by driving the press machine, i.e., the downward movement of the press machine, the crank pin dies 12 are placed in a state in which their impressions 12*a* receive the respective rough crank pin portions P' at their inner sides, so that the side surfaces of each crank pin dies 12 are in contact with corresponding ones of the rough arm portions A', at their rough crank pin portion P'-side side surfaces, the corresponding ones of the rough arm portions A' connecting with a corresponding one of the rough crank pin portions P'.

Then, the crank pin dies 12 and the auxiliary crank pin dies 13 are pressed downwardly together with continued downward movement of the press machine. Accordingly, with the axial movement of the movable journal dies 11U, 11B as described above, the crank pin dies 12 and the auxiliary crank pin dies 13 are moved axially along with them toward the stationary journal dies 10U, 10B for the third rough journal portion J3'. The movement of the crank pin dies 12 in the eccentric direction is accomplished by driving the hydraulic cylinder 16 coupled to the crank pin dies 12.

It is noted that the axial movement of the crank pin dies 12 and the auxiliary crank pin dies 13 may be forcibly caused using a wedge mechanism similar to the one for the movable journal dies 11U, 11B or a separate mechanism such as a hydraulic cylinder or a servo motor. The auxiliary crank pin dies 13 may be integral with one of their adjacent movable journal dies 11U, 11B.

In the initial condition shown in FIG. 3, spaces are provided between the axially arranged stationary journal dies 10U, 10B and the movable journal dies 11U, 11B and their corresponding crank pin dies 12 and the auxiliary crank pin dies 13, so as to allow the axial movement of the movable journal dies 11U, 11B as well as that of the crank pin dies 12 and the auxiliary crank pin dies 13. The size of the spaces represents the difference between the thickness of the rough arm portions A" of the blank for finish forging 5 and the thickness of the rough crank arm portions A' of the preform blank 4.

Now, descriptions are given of how the blank for finish forging is formed using the thus configured forming apparatus.

Figure 4:
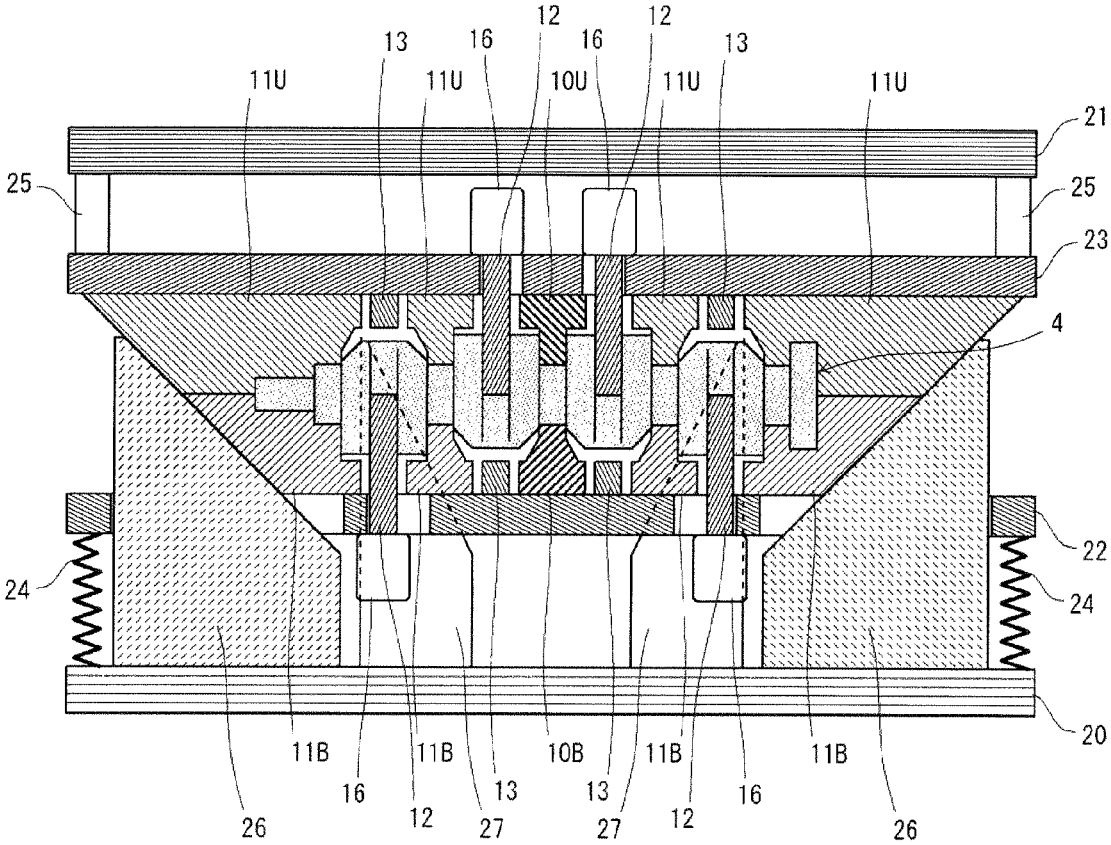
FIG. 4 is a longitudinal sectional view illustrating a process for faulting a blank for finish forging using the forming apparatus of the present invention shown in FIG. 3, with a state at an initial stage of forming shown therein.
Figure 5:
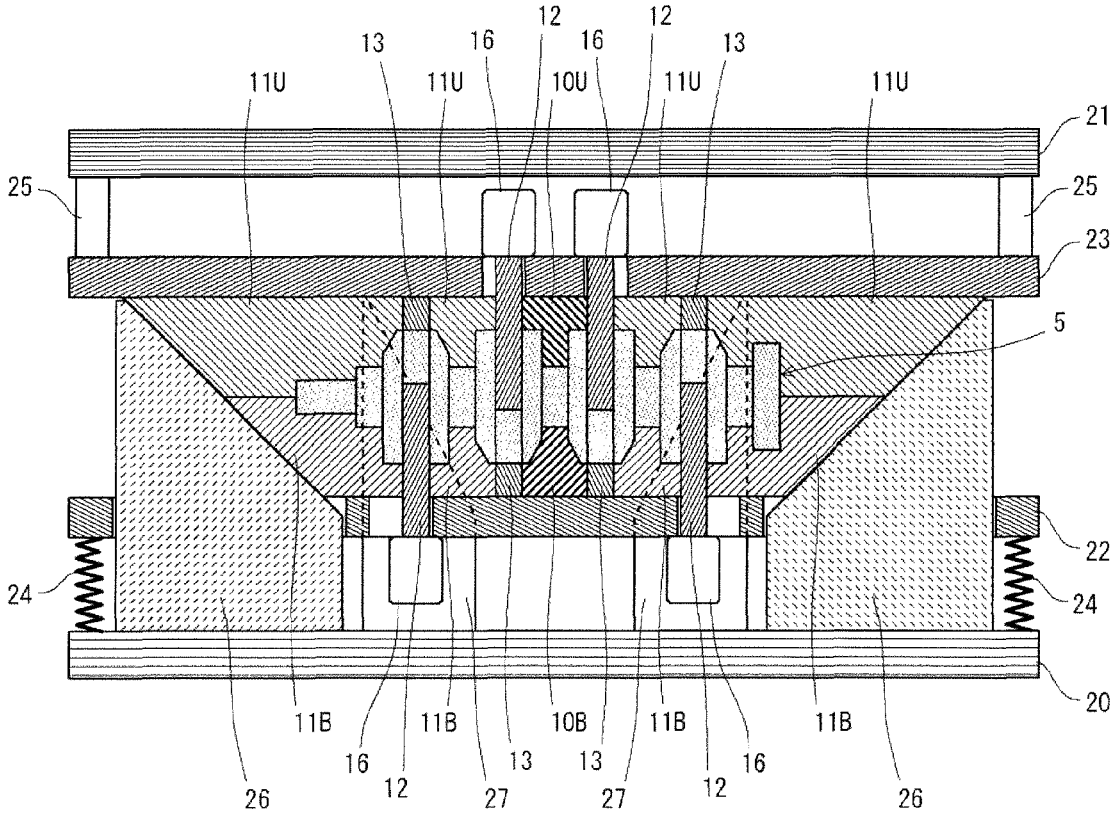
FIG. 5 is a longitudinal sectional view illustrating a process for forming a blank for finish forging using the forming apparatus of the present invention shown in FIG. 3, with a state at the completion of faulting shown therein.

FIG. 4 and FIG. 5 are longitudinal sectional views illustrating a process for forming a blank for finish forging using the forming apparatus of the present invention shown in FIG. 3, with FIG. 4 showing a state at an initial stage of forming and FIG. 5 showing a state at the completion of forming.

The preform blank 4 is placed in the lower stationary journal die 10B, the lower movable journal dies 11B, and the lower crank pin dies 12 and lower auxiliary crank pin dies 13 shown in FIG. 3, and then lowering of the press machine is started. Then, as shown in FIG. 4, the upper stationary journal dies 10U and the upper movable journal dies 11U are brought into contact with the respective lower stationary journal dies 10B and lower movable journal dies 10B.

Thus, the preform blank 4 is placed in a state in which the rough journal portions J' are held by the stationary journal dies 10U, 10B and the movable journal dies 11U, 11B from above and below, and the rough crank pin portions P', at their inner sides, are contacted by the crank pin dies 12. In this state, in the preform blank 4, the rough arm portions A', at their rough journal portion J'-side side surfaces, are in contact with the stationary journal dies 10U, 10B and the movable journal dies 11U, 11B, and, at their rough crank pin portion P'-side side surfaces, are in contact with the crank pin dies 12. Also, in this state, the inclined surfaces 14U, 14B of the movable journal dies 11U, 11B for the first and fifth rough journal portions J1', J5' are in contact with the slopes of the first wedges 26, and the inclined surfaces 15U, 15B of the movable journal dies 11U, 11B for the second and fourth rough journal portions J2', J4' are in contact with the slopes of the second wedges 27.

In this state, the lowering of the press machine is continued. Accordingly, the inclined surfaces 14U, 14B of the movable journal dies 11U, 11B for the first and fifth rough journal portions J1', J5' slide along the slopes of the first wedges 26, and by this wedge mechanism, these movable journal dies 11U, 11B are allowed to move axially toward the stationary journal dies 10U, 10B for the third rough journal portion J3'. Concurrently, the inclined surfaces 15U, 15B of the movable journal dies 11U, 11B for the second and fourth rough journal portions J2', J4' slide along the slopes of the second wedges 27, and by this wedge mechanism, these movable journal dies 11U, 11B are allowed to move axially toward the stationary journal dies 10U, 10B for the third rough journal portion J3'. By such axial movement of the movable journal dies 11U, 11B caused by the wedge mechanism, the crank pin dies 12 and the auxiliary crank pin dies 13 are also allowed to move axially toward the stationary journal dies 10U, 10B for the third rough journal portion J3'.

Accordingly, the spaces between the stationary journal dies 10U, 10B and the movable journal dies 11U, 11B and their corresponding crank pin dies 12 and auxiliary crank pin dies 13 are gradually reduced, and finally they disappear. In this process, in the preform blank 4, the rough arm portions A' are axially compressed by the stationary journal dies 10U, 10B, the movable journal dies 11U, 11B, and the crank pin dies 12 while the axial lengths of the rough journal portions J' and the rough crank pin portions P' are maintained, so that the thickness of the rough arm portions A' is reduced to the thickness of the rough arm portions A" of the blank for finish forging 5 (see FIG. 5).

Also, in response to the axial movement of the movable journal dies 11U, 11B as well as that of the crank pin dies 12 and the auxiliary crank pin dies 13, the hydraulic cylinder 16 for the crank pin dies 12 is driven. Accordingly, the crank pin dies 12 press the respective rough crank pin portions P' of the preform blank 4 in the eccentric direction. Thus, the rough crank pin portions P' of the preform blank 4 are displaced in the eccentric direction, and the amount of eccentricity is increased to the amount of eccentricity of the rough crank pin portions P" of the blank for finish forging 5 (see FIG. 5).

In this mariner, it is possible to form, from the preform blank 4 without a flash, the blank for finish forging 5 without a flash, which has a shape generally in agreement with the shape of the forged crankshaft (forged final product) having thin crank arms A. By using such a blank for finish forging 5 without a flash in finish forging and applying finish forging thereto, it is possible to obtain the final shape of the forged crankshaft including the contour shape of crank arms although some minor amount of flash is generated. Therefore, forged crankshafts for multiple cylinder engines can be manufactured with high material utilization and also with high dimensional accuracy regardless of their shapes. If, at the stage of preparing the preform blank, portions to be formed into balance weights are shaped in its arm portions, it is even possible to manufacture a forged crankshaft having balance weights.

In the forming apparatus shown in FIGS. 3 to 5, the inclined surfaces 14U, 14B of the movable journal dies 11U, 11B for the first rough journal portion J1' plus the slope of the first wedge 26 that is in contact therewith and the inclined surfaces 14U, 14B of the movable journal dies 11U, 11B for the fifth rough journal portion J5' plus the slope of the first wedge 26 that is in contact therewith are angled in a reverse relationship relative to a vertical plane. Also, the inclined surfaces 15U, 15B of the movable journal dies 11U, 11B for the second rough journal portion J2' plus the slope of the second wedge 27 that is in contact therewith and the inclined surfaces 15U, 15B of the movable journal dies 11U, 11B for the fourth rough journal portion J4' plus the slope of the second wedge 27 that is in contact therewith are angled in a reverse relationship relative to a vertical plane. Furthermore, the angle of the slopes of the first wedges 26 (the angle of the inclined surfaces 14U, 14B of the movable journal dies 11U, 11B for the first and fifth rough journal portions J1', J5') is greater than the angle of the slopes of the second wedges 27 (the angle of the inclined surfaces 15U, 15B of the movable journal dies 11U, 11B for the second and fourth rough journal portions J2', J4'). The purpose of varying, for each of the movable journal dies 11U, 11B, the wedge angle of the wedge mechanism, which causes the axial movement of the movable journal dies 11U, 11B, is to ensure that the rate of deformation at which the rough arm portions A' are axially compressed to reduce the thickness thereof can be constant for all the rough arm portions A'.

In the preform blank 4 which is to be processed by the forming apparatus shown in FIGS. 3 to 5, the rough journal portions J' have a cross-sectional area that is equal to or greater than that of the rough journal portions J" of the blank for finish forging 5, i.e., that of the journal J of the forged crankshaft. Likewise, the rough crank pin portions P' of the preform blank 4 have a cross-sectional area that is equal to or greater than that of the rough crank pin portions P" of the blank for finish forging 5, i.e., that of the crank pins P of the forged crankshaft. Even when the cross-sectional area of the rough journal portions J' of the preform blank 4 is greater than the cross-sectional area of the rough journal portions J" of the blank for finish forging 5 and the cross-sectional area of the rough crank pin portions P' of the preform blank 4 is greater than the cross-sectional area of the rough crank pin portions P" of the blank for finish forging 5, the cross-sectional area of the rough journal portions J' can be reduced to the cross-sectional area of the rough journal portions J" of the blank for finish forging 5 by the holding and retaining of the rough journal portions J' by the stationary journal dies 10U, 10B and the movable journal dies 11U, 11B, and by the subsequent axial movement of the movable journal dies 11U, 11B; and the cross-sectional area of the rough crank pin portions P' can be reduced to the cross-sectional area of the rough crank pin portions P" of the blank for finish forging 5 by the axial movement and the movement in the eccentric direction of the crank pin dies 12.

An issue to be addressed regarding the forming of the blank for finish forging described above is local formation of fin flaws. The following describes how fin flaws are formed and how they can be prevented.

Figure 6:
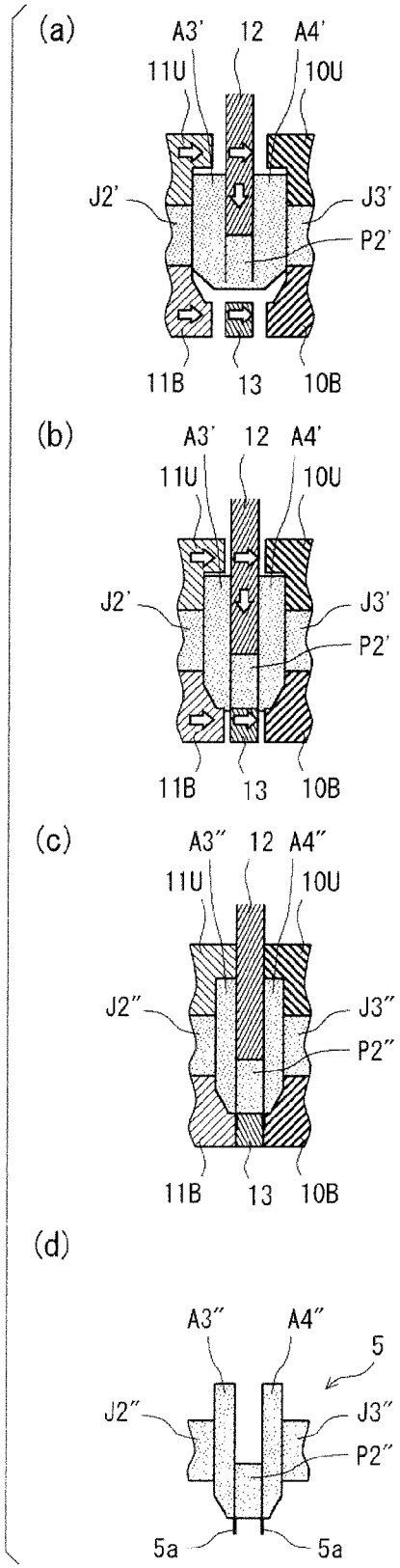
FIG. 6 is a diagram illustrating how fin flaws occur in forming a blank for finish forging using the forming apparatus of the present invention.
Figure 7:
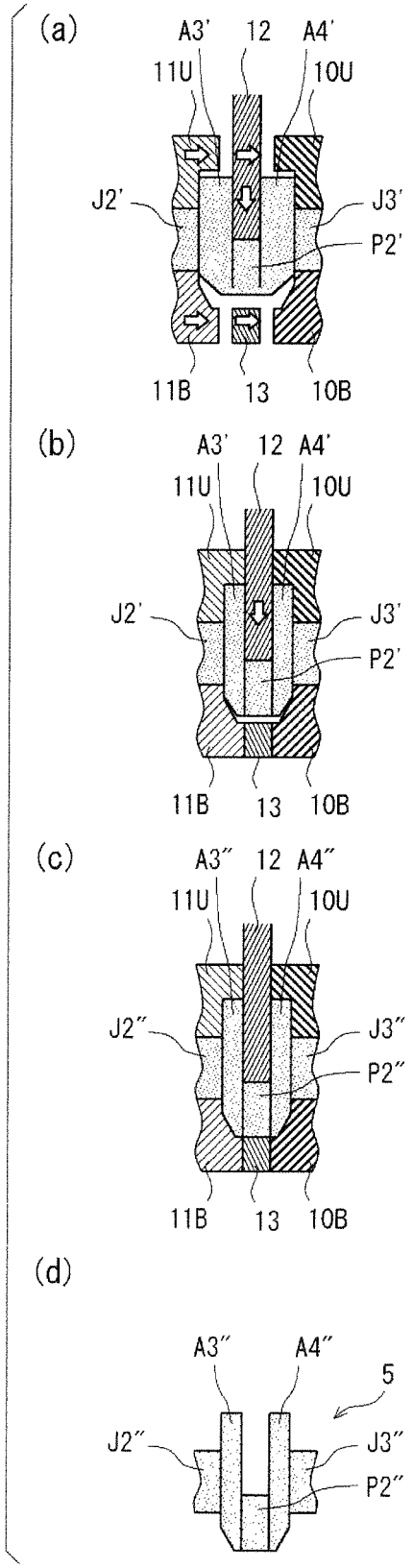
FIG. 7 is a diagram illustrating how fin flaws are prevented by taking a measure in forming a blank for finish forging using the forming apparatus of the present invention.

FIG. 6 is a diagram illustrating how fin flaws occur in forming a blank for finish forging using the forming apparatus of the present invention, and FIG. 7 is a diagram illustrating how fin flaws are prevented by taking a measure. In FIGS. 6 and 7, (a) shows a state at an initial stage of forming; (b) shows a state during the process of forming; (c) shows a state at the completion of forming; and (d) shows the blank for finish forging removed from the forming apparatus after the completion of forming.

As shown in FIG. 6(*a*), upon the start of the forming operation, the movable journal dies 11U, 11B move axially, and the crank pin dies 12 and the auxiliary crank pin dies 13 move axially and in the eccentric direction. Then, as shown in FIG. 6(*b*), if the rough crank pin portions P' in the process of eccentric deformation reach the auxiliary crank pin dies 13 before the completion of the axial movement of the movable journal dies 11U, 11B and the crank pin dies 12 and the auxiliary crank pin dies 13, i.e., before the spaces between the stationary journal dies 10U, 10B and the movable journal dies 11U, 11B and their corresponding crank pin dies 12 and auxiliary crank pin dies 13 are filled, the fillings of the rough crank pin portions P' flow into the spaces between the auxiliary crank pin dies 13 and their corresponding stationary journal dies 10U, 10B and movable journal dies 11U, 11B. Although the fillings that have flowed thereinto are thinned with the progress of the forming operation, they remain there even after the forming operation is completed as shown in FIG. 6(*c*). Thus, as shown in FIG. 6(*d*), fin flaws 5*a*, coming out of the rough crank pin portions P" of the blank for finish forging 5, are formed locally at the boundaries with adjacent rough arm portions.

In the subsequent finish forging step, the fin flaws 5*a* will be struck into the finished product, resulting in overlaps. Therefore, in order to ensure product quality, it is necessary to prevent the formation of fin flaws.

One measure to prevent the formation of fin flaws may be to control the movement of the crank pin dies 12 in the eccentric direction so that the rough crank pin portions P' in the process of eccentric deformation reach the auxiliary crank pin dies 13 after the spaces between the stationary journal dies 10U, 10B and the movable journal dies 11U, 11B and their corresponding crank pin dies 12 and auxiliary crank pin dies 13 are filled. Specifically, the movement of the crank pin dies 12 in the eccentric direction may be completed after the axial movement of the movable journal dies 11U, 11B and the crank pin dies 12 and the auxiliary crank pin dies 13 is completed. For example, when the total length of movement of the crank pin dies 12 in the eccentric direction is designated as a 100% length of movement thereof, it is preferred that, at the completion of the axial movement of the movable journal dies 11U, 11B that are adjacent to the crank pin dies 12, the length of movement of the crank pin dies 12 in the eccentric direction is 90% or less (more preferably 83% or less, and even more preferably 60% or less) of the total length of movement, and thereafter, the movement of the crank pin dies 12 in the eccentric direction is completed.

That is, the forming operation is started as shown in FIG. 7(*a*), and then, as shown in FIG. 7(*b*), the axial movement of the movable journal dies 11U, 11B as well as that of the crank pin dies 12 and the auxiliary crank pin dies 13 is completed before the length of movement of the crank pin dies 12 in the eccentric direction reaches 90% of the total length of movement. Consequently, by this time, the spaces between the stationary journal dies 10U, 10B and the movable journal dies 11U, 11B and their corresponding crank pin dies 12 and auxiliary crank pin dies 13 have been filled, whereas the rough crank pin portions P' in the process of eccentric deformation have not reached the auxiliary crank pin dies 13. Subsequently, along with the movement of the crank pin dies 12 in the eccentric direction, the rough crank pin portions P' reach the auxiliary crank pin dies 13, and with the completion of the movement, the forming is completed as shown in FIG. 7(*c*). Thus, no such problem occurs as the fillings of the rough crank pin portions P' flow into the spaces between the auxiliary crank pin dies 13 and their corresponding stationary journal dies 10U, 10B and movable journal dies 11U, 11B. As a result, as shown in FIG. 7(*d*), a high quality blank for finish forging 5 without fin flaws can be obtained.

The process of movement of the crank pin dies in the eccentric direction before the completion of the axial movement of the movable journal dies may be varied as desired. For example, the movement of the crank pin dies in the eccentric direction may be started simultaneously with the start of the axial movement of the movable journal dies or in advance of that, or conversely, it may be started after the axial movement of the movable journal dies has progressed to some extent. Also, the movement of the crank pin dies in the eccentric direction may be stopped temporarily, after its start, at positions a certain distance away from their initial positions, and it may be resumed after the completion of the axial movement of the movable journal dies.

The present invention is not limited to the embodiments described above, and various modifications may be made without departing from the spirit and scope of the present invention. For example, the mechanism for causing the movable journal dies to move axially is not limited to the one described in the above embodiment, in which a wedge mechanism of a press machine is employed. Alternatively, a link mechanism may be employed, or a hydraulic cylinder or a servo motor may be employed in place of a press machine. Furthermore, the mechanism for causing the crank pin dies to move in the eccentric direction is not limited to a hydraulic cylinder, and it may be a servo motor.

Furthermore, the embodiment described above has such a configuration that the upper die holder is secured to the upper pressure pad while the lower die holder is resiliently supported on the lower pressure pad on which the wedges are installed, and the upper and lower movable journal dies are allowed to move by the wedges, but alternatively, the functions of the upper section and the lower section may be reversed. The configuration may also be such that the upper and lower die holders are resiliently supported on the respective pressure pads, and that wedges are installed on both pressure pads so that the upper and lower movable journal dies are caused to move by their corresponding wedges.

Furthermore, in the above embodiment, the auxiliary crank pin dies are movable only axially, but additionally, they may be made to be movable also in a direction opposite to the eccentric direction, so that the crank pin dies and the auxiliary crank pin dies can hold and retain the rough crank pin portions P' therebetween from above and below and meanwhile move in the eccentric direction cooperatively with each other.

EXAMPLES

To verify the advantages of the present invention, a blank for finish forging for use in manufacturing a 4-cylinder 8-counterweight crankshaft was formed using the forming apparatus shown in FIG. 3. The result was that the overall length of the blank was reduced from 338 mm to 270 mm. More specifically, the thickness of the first and eighth rough arm portions was reduced from 20.85 mm to 10.4 mm, and the thickness of the second to seventh rough arm portions was reduced from 17.55 mm to 9.7 mm. Moreover, no fin flaws were formed because the axial movement of the movable journal dies as well as that of the crank pin dies and the auxiliary crank pin dies was completed before the length of movement of the crank pin dies in the eccentric direction reached 60% of the total length of movement. Furthermore, no fin flaws were formed also in the case where the axial movement of the movable journal dies as well as that of the crank pin dies and the auxiliary crank pin dies was completed before the length of movement of the crank pin dies in the eccentric direction reached 83% of the total length of movement.

INDUSTRIAL APPLICABILITY

The present invention is useful in manufacturing forged crankshafts for multiple cylinder engines.

REFERENCE SIGNS LIST

1: forged crankshaft, J, J1 to J5: journals,
P, P1 to P4: crank pins, Fr: front part,
F1: flange, A, A1 to A8: crank arms,
2: billet,
4: preform blank, J', J1' to J5': rough journal portions,
P', P1' to P4': rough crank pin portions, Fr': rough front part portion,
F1': rough flange portion,
A', A1' to A8': rough crank arm portions,
5: blank for finish forging, J", J1" to J5": rough journal portions,
P", P1' to P4": rough crank pin portions, Fr': rough front part portion,
F1': rough flange portion,
A", A1" to A8": rough crank arm portions,
5*a*: fin flaws,
10U, 10B: stationary journal die,
11U, 11B: movable journal die,
12: crank pin die, 12*a*: impression,
13: auxiliary crank pin die, 13*a*: impression,
10Ua, 10Ba: first impression of stationary journal die,
10Ub, 10Bb: second impression of stationary journal die,
11Ua, 11Ba: first impression of movable journal die,
11Ub, 11Bb: second impression of movable journal die,
14U, 14B: inclined surfaces of movable journal dies for first and fifth rough journal portions,
15U, 15B: inclined surfaces of movable journal dies for second and fourth rough journal portions,
16: hydraulic cylinder,
20: lower pressure pad, 21: upper pressure pad,
22: lower die holder, 23: upper die holder,
24: resilient member, 25: support post,
26: first wedge, 27: second wedge

What is claimed is:

1. An apparatus for forming a blank for finish forging for a forged crankshaft, the apparatus configured to form, in a process of manufacturing a forged crankshaft for a multiple cylinder engine, a blank, the apparatus configured to form the blank for finish forging from a preform blank having a crankshaft shape, the preform blank including: rough journal portions having an axial length equal to an axial length of journals of the forged crankshaft; rough crank pin portions having an axial length equal to an axial length of crank pins of the forged crankshaft and having a smaller amount of eccentricity in an eccentric direction perpendicular to the axial direction than an amount of eccentricity of the crank pins of the forged crankshaft; and rough crank arm portions having an axial thickness greater than an axial thickness of crank arms of the forged crankshaft, the apparatus, comprising:

stationary journal dies disposed at locations corresponding to a location of only one rough journal portion of the rough journal portions, the stationary journal dies configured to hold and retain the only one rough journal portion therebetween in the eccentric direction perpendicular to the axial direction, the stationary journal dies configured to be in contact with side surfaces of corresponding ones of the rough crank arm portions, the corresponding ones of the rough crank arm portions connecting with the one rough journal portion;

movable journal dies disposed at locations corresponding to locations of the rough journal portions excluding the only one rough journal portion to be held by the stationary journal dies, the movable journal dies configured to hold and retain the rough journal portions excluding the only one rough journal portion to be held by the stationary journal dies therebetween in the eccentric direction perpendicular to the axial direction at a holding and retaining position, the movable journal dies configured to move axially toward the stationary journal dies while being in contact with side surfaces of corresponding ones of the rough crank arm portions, the corresponding ones of the rough crank arm portions each connecting with a corresponding one of the rough journal portions, the moveable journal dies configured to move axially from the holding and retaining position to an operating position for compressing the rough crank arm portions in the axial direction so as to reduce the thickness thereof to the thickness of the crank arms of the forged crankshaft; and crank pin dies disposed at locations corresponding to locations of the rough crank pin portions, the crank pin dies configured to be brought into contact with the respective rough crank pin portions at inner sides thereof, the crank pin dies configured to move axially toward the stationary journal dies and in the eccentric direction perpendicular to the axial direction while being in contact with side surfaces of corresponding ones of the rough crank arm portions, the corresponding ones of the rough crank arm portions each connecting with a corresponding one of the rough crank pin portions, wherein, in a state where the rough journal portions are held and retained by the stationary journal dies and the movable journal dies and the rough crank pin portions are contacted by the crank pin dies, the movable journal dies are moved axially to the operating position, and the crank pin dies are moved axially and in the eccentric direction, thereby compressing the rough crank arm portions in the axial direction so as to reduce the thickness thereof to the thickness of the crank arms of the forged crankshaft, and pressing the rough crank pin portions in the eccentric direction so as to increase the amount of eccentricity thereof to the amount of eccentricity of the crank pins of the forged crankshaft.

2. The apparatus for forming a blank for finish forging for a forged crankshaft according to claim 1, wherein the crank pin dies each include an auxiliary crank pin die disposed at a location facing an outer side, opposite to the inner side, of each rough crank pin portion, the auxiliary crank pin dies configured to move axially, and wherein the movement of the crank pin dies in the eccentric direction is controlled so that the rough crank pin portions to be eccentrically deformed reach the auxiliary crank pin dies after spaces between the stationary journal dies and the movable journal dies and corresponding ones of the crank pin dies and the auxiliary crank pin dies are filled by the axial movement of the movable journal dies as well as the axial movement of the crank pin dies and the auxiliary crank pin dies.

3. The apparatus for forming a blank for finish forging for a forged crankshaft according to claim 2, wherein, provided that a total length of movement of the crank pin dies in the eccentric direction is a 100% length of movement thereof, when the axial movement of the movable journal dies that are adjacent to the crank pin dies is completed, a length of movement of the crank pin dies in the eccentric direction is 90% or less of the total length of movement, and thereafter, the movement of the crank pin dies in the eccentric direction is completed.

4. The apparatus for forming a blank for finish forging for a forged crankshaft according to claim 3, wherein the stationary journal dies, the movable journal dies, and the crank pin dies are mounted on a press machine that is capable of being moved downward along the eccentric direction, and wherein, by downward movement of the press machine, the stationary journal dies and the movable journal dies are caused to hold and retain the rough journal portions therebetween, and the crank pin dies are brought into contact with the rough crank pin portions; and with continued downward movement of the press machine, the movable journal dies are moved axially by wedge mechanisms, and the crank pin dies are caused to move axially by the movement of the movable journal dies.

5. The apparatus for forming a blank for finish forging for a forged crankshaft according to claim 4, wherein the wedge mechanisms have different wedge angles for each of the movable journal dies.

6. The apparatus for forming a blank for finish forging for a forged crankshaft according to claim 5, wherein the crank pin dies are coupled to a hydraulic cylinder and caused to move in the eccentric direction by driving the hydraulic cylinder.

7. The apparatus for forming a blank for finish forging for a forged crankshaft according to claim 4, wherein the crank pin dies are coupled to a hydraulic cylinder and caused to move in the eccentric direction by driving the hydraulic cylinder.

8. The apparatus for forming a blank for finish forging for a forged crankshaft according to claim 2, wherein the stationary journal dies, the movable journal dies, and the crank pin dies are mounted on a press machine that is capable of being moved downward along the eccentric direction, and wherein, by downward movement of the press machine, the stationary journal dies and the movable journal dies are caused to hold and retain the rough journal portions therebetween, and the crank pin dies are brought into contact with the rough crank pin portions; and with continued downward movement of the press machine, the movable journal dies are moved axially by wedge mechanisms, and the crank pin dies are caused to move axially by the movement of the movable journal dies.

9. The apparatus for forming a blank for finish forging for a forged crankshaft according to claim 8, wherein the wedge mechanisms have different wedge angles for each of the movable journal dies.

10. The apparatus for forming a blank for finish forging for a forged crankshaft according to claim 9, wherein the crank pin dies are coupled to a hydraulic cylinder and caused to move in the eccentric direction by driving the hydraulic cylinder.

11. The apparatus for forming a blank for finish forging for a forged crankshaft according to claim 8, wherein the crank pin dies are coupled to a hydraulic cylinder and caused to move in the eccentric direction by driving the hydraulic cylinder.

12. The apparatus for forming a blank for finish forging for a forged crankshaft according to claim 2, wherein, when the rough journal portions have a cross-sectional area greater than a cross-sectional area of the journals of the forged crankshaft and the rough crank pin portions have a cross-sectional area greater than a cross-sectional area of the crank pins of the forged crankshaft, the cross-sectional area of the rough journal portions is reduced to the cross-sectional area of the journals of the forged crankshaft by holding and retaining of the rough journal portions by the stationary journal dies and the movable journal dies and subsequent axial movement of the movable journal dies; and the cross-sectional area of the rough crank pin portions is reduced to the cross-sectional area of the crank pins of the forged crankshaft by the axial movement as well as the movement in the eccentric direction of the crank pin dies.

13. The apparatus for forming a blank for finish forging for a forged crankshaft according to claim 1, wherein the stationary journal dies, the movable journal dies, and the crank pin dies are mounted on a press machine that is capable of being moved downward along the eccentric direction, and wherein, by downward movement of the press machine, the stationary journal dies and the movable journal dies are caused to hold and retain the rough journal portions therebetween, and the crank pin dies are brought into contact with the rough crank pin portions; and with continued downward movement of the press machine, the movable journal dies are moved axially by wedge mechanisms, and the crank pin dies are caused to move axially by the movement of the movable journal dies.

14. The apparatus for forming a blank for finish forging for a forged crankshaft according to claim 13, wherein the wedge mechanisms have different wedge angles for each of the movable journal dies.

15. The apparatus for forming a blank for finish forging for a forged crankshaft according to claim 14, wherein the crank pin dies are coupled to a hydraulic cylinder and caused to move in the eccentric direction by driving the hydraulic cylinder.

16. The apparatus for forming a blank for finish forging for a forged crankshaft according to claim 13, wherein the crank pin dies are coupled to a hydraulic cylinder and caused to move in the eccentric direction by driving the hydraulic cylinder.

17. The apparatus for forming a blank for finish forging for a forged crankshaft according to claim 1, wherein, when the rough journal portions have a cross-sectional area greater than a cross-sectional area of the journals of the forged crankshaft and the rough crank pin portions have a cross-sectional area greater than a cross-sectional area of the crank pins of the forged crankshaft, the cross-sectional area of the rough journal portions is reduced to the cross-sectional area of the journals of the forged crankshaft by holding and retaining of the rough journal portions by the stationary journal dies and the movable journal dies and subsequent axial movement of the movable journal dies; and the cross-sectional area of the rough crank pin portions is reduced to the cross-sectional area of the crank pins of the forged crankshaft by the axial movement as well as the movement in the eccentric direction of the crank pin dies.

* * * * *